US009824681B2

(12) United States Patent
Luan et al.

(10) Patent No.: US 9,824,681 B2
(45) Date of Patent: Nov. 21, 2017

(54) TEXT-TO-SPEECH WITH EMOTIONAL CONTENT

(71) Applicant: Microsoft Corporation, Redmond, WA (US)

(72) Inventors: Jian Luan, Beijing (CN); Lei He, Beijing (CN); Max Leung, Beijing (CN)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 116 days.

(21) Appl. No.: 14/483,153

(22) Filed: Sep. 11, 2014

(65) Prior Publication Data

US 2016/0078859 A1 Mar. 17, 2016

(51) Int. Cl.

| | |
|---|---|
| ***G10L 13/00*** | (2006.01) |
| ***G10L 13/08*** | (2013.01) |
| ***G10L 13/027*** | (2013.01) |
| ***G10L 13/033*** | (2013.01) |

(52) U.S. Cl.

CPC ..... *G10L 13/027* (2013.01); *G10L 13/033* (2013.01)

(58) Field of Classification Search

CPC ..... G10L 13/033; G10L 13/06; G10L 13/04; G10L 13/08; G10L 13/10; G10L 21/003; G10L 13/02; G10L 15/1807; G10L 15/187

USPC ..... 704/258, 260

See application file for complete search history.

(56) References Cited

U.S. PATENT DOCUMENTS

| | | | | |
|---|---|---|---|---|
| 6,950,798 | B1 * | 9/2005 | Beutnagel | G10L 13/07 704/258 |
| 7,280,968 | B2 | 10/2007 | Blass | |
| 8,036,899 | B2 * | 10/2011 | Sobol-Shikler | G10L 13/033 704/258 |
| 8,065,150 | B2 | 11/2011 | Eide | |
| 8,224,652 | B2 | 7/2012 | Wang et al. | |

(Continued)

FOREIGN PATENT DOCUMENTS

EP 2650874 A1 10/2013

OTHER PUBLICATIONS

Latorre et al, "Training a supra-segmental parametric F0 model without interpolating F0," May 2013, In Acoustics, Speech and Signal Processing (ICASSP), 2013 IEEE International Conference on, Vancouver, BC, 2013, pp. 6880-6884.*

(Continued)

*Primary Examiner* — Olujimi Adesanya

(74) *Attorney, Agent, or Firm* — Law Offices of Richard Chi; Richard Chi

(57) ABSTRACT

Techniques for converting text to speech having emotional content. In an aspect, an emotionally neutral acoustic trajectory is predicted for a script using a neutral model, and an emotion-specific acoustic trajectory adjustment is independently predicted using an emotion-specific model. The neutral trajectory and emotion-specific adjustments are combined to generate a transformed speech output having emotional content. In another aspect, state parameters of a statistical parametric model for neutral voice are transformed by emotion-specific factors that vary across contexts and states. The emotion-dependent adjustment factors may be clustered and stored using an emotion-specific decision tree or other clustering scheme distinct from a decision tree used for the neutral voice model.

20 Claims, 12 Drawing Sheets

(56) References Cited

U.S. PATENT DOCUMENTS

| | | | | |
|---|---|---|---|---|
| 9,472,182 | B2 * | 10/2016 | Luan | G10L 13/02 |
| 2003/0093280 | A1 * | 5/2003 | Oudeyer | G10L 13/033 704/266 |
| 2006/0095264 | A1 * | 5/2006 | Wu | G10L 13/06 704/260 |
| 2006/0136213 | A1 * | 6/2006 | Hirose | G10L 13/033 704/260 |
| 2007/0213981 | A1 * | 9/2007 | Meyerhoff | G10L 17/26 704/243 |
| 2008/0044048 | A1 * | 2/2008 | Pentland | H04S 1/007 381/315 |
| 2008/0235024 | A1 | 9/2008 | Goldberg et al. | |
| 2008/0294741 | A1 * | 11/2008 | Dos Santos | G06Q 10/107 709/206 |
| 2009/0037179 | A1 * | 2/2009 | Liu | G10L 13/033 704/260 |
| 2009/0063154 | A1 | 3/2009 | Gusikhin et al. | |
| 2009/0177474 | A1 * | 7/2009 | Morita | G10L 13/07 704/260 |
| 2013/0041669 | A1 | 2/2013 | Ben et al. | |
| 2013/0054244 | A1 | 2/2013 | Bao et al. | |
| 2013/0218568 | A1 * | 8/2013 | Tamura | G10L 13/033 704/260 |
| 2013/0262109 | A1 * | 10/2013 | Latorre-Martinez | G10L 15/26 704/235 |
| 2013/0262119 | A1 * | 10/2013 | Latorre-Martinez | G10L 13/08 704/260 |
| 2014/0067397 | A1 | 3/2014 | Radebaugh | |
| 2016/0078859 | A1 * | 3/2016 | Luan | G10L 13/033 704/260 |

OTHER PUBLICATIONS

Tooher et al, "Transformation of LF parameters for speech synthesis of emotion: regression trees",2008, in Proceedings of the 4th International Conference on Speech Prosody, Campinas, Brazil, ISCA, 2008, pp. 705-708.*

Tao et al, "Prosody conversion from neutral speech to emotional speech," Jul. 2006, in IEEE Transactions on Audio, Speech, and Language Processing, vol. 14, No. 4, pp. 1145-1154.*

Pribilova et al, "Spectrum Modification for Emotional Speech Synthesis," 2009, In Multimodal Signals: Cognitive and Algorithmic Issues, pp. 232-241.*

Latorre et al, "Speech factorization for HMM-TTS based on cluster adaptive training," 2012, in Proc. Interspeech, 2012.*

Latorre et al, "Training a parametric-based logf0 model with the minimum generation error criterion,", 2010, in Proc. Interspeech, 2010, pp. 2174-2177.*

Aihara et al, "GMM-based emotional voice conversion using spectrum and prosody features," , 2012, In American Journal of Signal Processing, vol. 2, No. 5.*

Erro et al, "Emotion Conversion Based on Prosodic Unit Selection," Jul. 2010, in IEEE Transactions on Audio, Speech, and Language Processing, vol. 18, No. 5, pp. 974-983.*

Jia, et al., "Emotional Audio-Visual Speech Synthesis Based on PAD", In IEEE Transactions on Audio, Speech, and Language Processing, vol. 19, Issue 3, Mar. 2011, pp. 570-582.

Chandak, et al., "Text to Speech Synthesis with Prosody feature: Implementation of Emotion in Speech Output using Forward Parsing", In International Journal of Computer Science and Security, vol. 4, Issue 3, Mar. 2013, pp. 352-360.

Bhutekar, et al., "Corpus Based Emotion Extraction to Implement Prosody Feature in Speech Synthesis Systems", In International Journal of Computer and Electronics Research, vol. 1, Issue 2, Aug. 2012, pp. 67-75.

Albrecht, et al., ""May I talk to you?:-)"—Facial Animation from Text", In Proceedings 10th Pacific Conference on Computer Graphics and Applications, Oct. 9, 2002, 10 pages.

Cen, et al., "Generating Emotional Speech from Neutral Speech", In Proceedings of 7th International Symposium on Chinese Spoken Language Processing, Nov. 29, 2010, pp. 383-386.

Zen, et al., "Statistical Parametric Speech Synthesis," Preprint submitted to Speech Communication, Apr. 6, 2009.

Tamura, et al., "Adaptation of Pitch and Spectrum for HMM-Based Speech Synthesis Using MLLR," Proc. ICASSP, 2001, pp. 805-808.

Yamagishi, Junichi, "An Introduction to HMM-Based Speech Synthesis," Oct. 2006, available at https://wiki.inf.ed.ac.uk/twiki/pub/CSTR/TrajectoryModelling/HTS-Introduction.pdf.

"International Search Report and Written Opinion Issued in PCT Application No. PCT/US2015/048755", dated Nov. 19, 2015, 12 pages.

Qin, et al., "HMM-Based Emotional Speech Synthesis Using Average Emotion Model", In Lecture Notes in Computer Science on Chinese Spoken Language Processing, vol. 4274, Jan. 1, 2006, pp. 233-240.

Yamagish, Junichi, "Average-Voice-Based Speech Synthesis", Retrieved from <<http://www.kbys.ip.titech.ac.jp/yamagishi/pdf/Yamagishi-D_thesis.pdf>>, Mar. 1, 2006, 177 Pages.

Yamagishi, et al., "Speaking Style Adaptation Using Context Clustering Decision Tree for Hmm-Based Speech Synthesis", In Proceedings of the International Conference on Acoustics, Speech and Signal Processing, vol. 1, May 17, 2004, 4 Pages.

"Second Written Opinion Issued in PCT Application No. PCT/US2015/048755", dated Apr. 20, 2016, 04 Pages.

"International Preliminary Report on Patentability Issued in PCT Application No. PCT/US2015/048755", dated Nov. 24, 2016, 8 Pages.

* cited by examiner

TEXT-TO-SPEECH WITH EMOTIONAL CONTENT

BACKGROUND

Field

The disclosure relates to techniques for text-to-speech conversion with emotional content.

Background

Computer speech synthesis is an increasingly common human interface feature found in modern computing devices. In many applications, the emotional impression conveyed by the synthesized speech is important to the overall user experience. The perceived emotional content of speech may be affected by such factors as the rhythm and prosody of the synthesized speech.

Text-to-speech techniques commonly ignore the emotional content of synthesized speech altogether by generating only emotionally "neutral" renditions of a given script. Alternatively, text-to-speech techniques may utilize separate voice models for separate emotion types, leading to the relatively high costs associated with storing separate voice models in memory corresponding to the many emotion types. Such techniques are also inflexible when it comes to generating speech with emotional content for which no voice models are readily available.

Accordingly, it would be desirable to provide novel and efficient techniques for text-to-speech conversion with emotional content.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, various aspects of the subject matter described herein are directed towards techniques for generating speech output having emotional content. In an aspect, a "neutral" representation of a script is prepared using an emotionally neutral model. Emotion-specific adjustments are separately prepared for the script based on a desired emotion type for the speech output, and the emotion-specific adjustments are applied to the neutral representation to generate a transformed representation. In an aspect, the emotion-specific adjustments may be applied on a per-phoneme, per-state, or per-frame basis, and may be stored and categorized (or clustered) by an independent emotion-specific decision tree or other clustering scheme. The clustering schemes for each emotion type may be distinct both from each other and from a clustering scheme used for the neutral model parameters.

Other advantages may become apparent from the following detailed description and drawings.

DETAILED DESCRIPTION

Various aspects of the technology described herein are generally directed towards a technology for generating speech output with given emotion type. The detailed description set forth below in connection with the appended drawings is intended as a description of exemplary aspects of the invention and is not intended to represent the only exemplary aspects in which the invention can be practiced. The term "exemplary" used throughout this description means "serving as an example, instance, or illustration," and should not necessarily be construed as preferred or advantageous over other exemplary aspects. The detailed description includes specific details for the purpose of providing a thorough understanding of the exemplary aspects of the invention. It will be apparent to those skilled in the art that the exemplary aspects of the invention may be practiced without these specific details. In some instances, well-known structures and devices are shown in block diagram form in order to avoid obscuring the novelty of the exemplary aspects presented herein.

Figure 1:
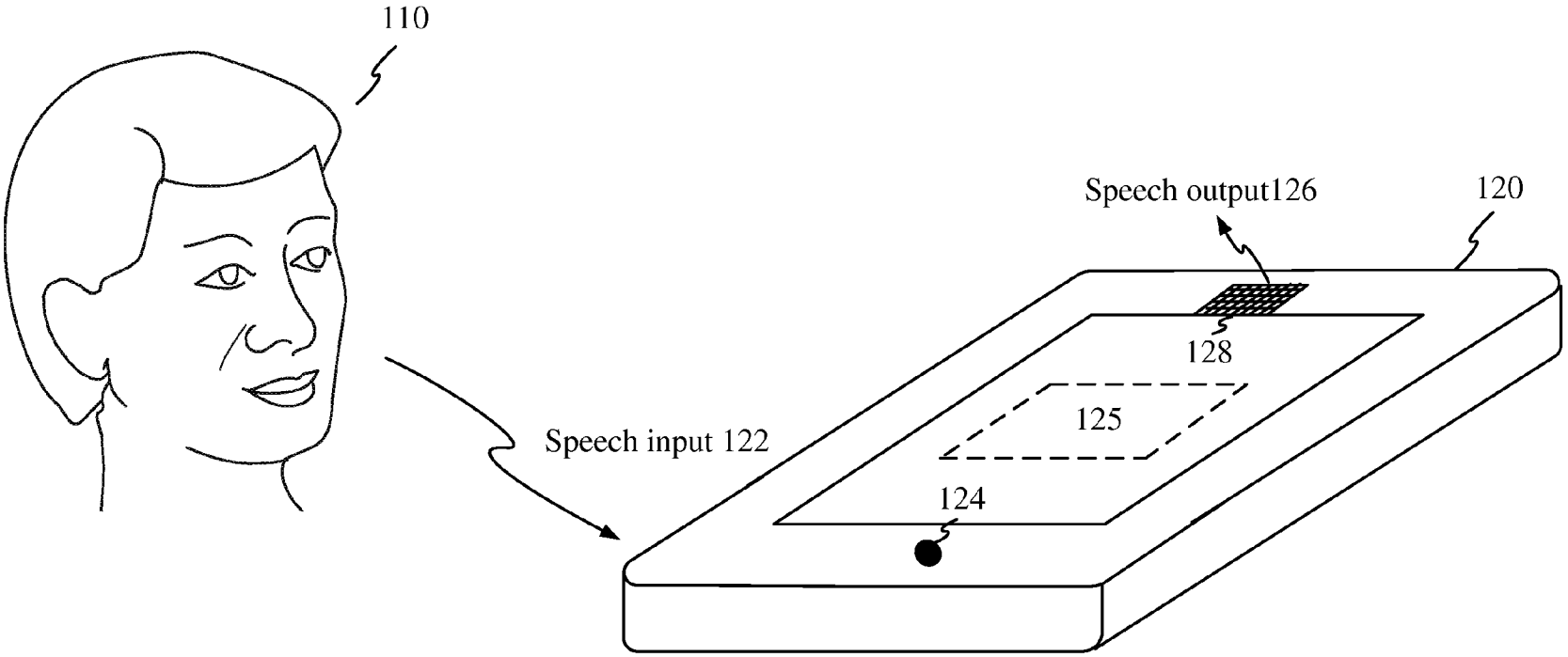
FIG. 1 illustrates a scenario employing a smartphone wherein techniques of the present disclosure may be applied.

FIG. 1 illustrates a scenario employing a smartphone wherein techniques of the present disclosure may be applied. Note FIG. 1 is shown for illustrative purposes only, and is not meant to limit the scope of the present disclosure to only applications of the present disclosure to smartphones. For example, techniques described herein may readily be applied in other scenarios, e.g., in the human interface systems of notebook and desktop computers, automobile navigation systems, etc. Such alternative applications are contemplated to be within the scope of the present disclosure.

In FIG. 1, user 110 communicates with computing device 120, e.g., a handheld smartphone. User 110 may provide speech input 122 to microphone 124 on device 120. One or more processors 125 within device 120 may process the speech signal received by microphone 124, e.g., performing functions as further described with reference to FIG. 2 hereinbelow. Note processors 125 for performing such functions need not have any particular form, shape, or functional partitioning.

Based on the processing performed by processor 125, device 120 may generate speech output 126 responsive to speech input 122, using audio speaker 128. Note in alternative processing scenarios, device 120 may also generate speech output 126 independently of speech input 122, e.g., device 120 may autonomously provide alerts or relay messages from other users (not shown) to user 110 in the form of speech output 126.

Figure 2:
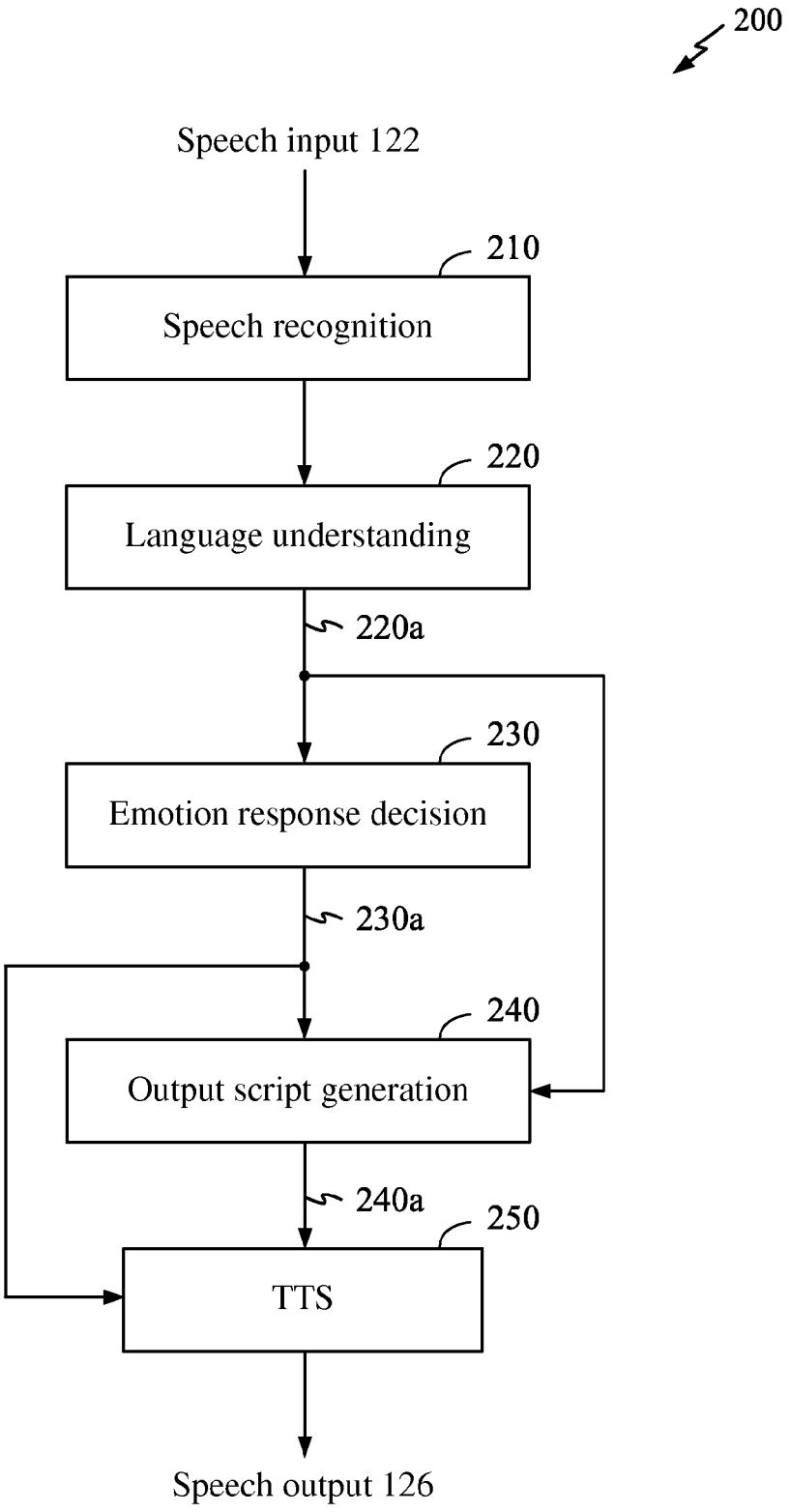
FIG. 2 illustrates an exemplary embodiment of processing that may be performed by a processor and other elements of a device for implementing a speech dialog system.

FIG. 2 illustrates an exemplary embodiment of processing that may be performed by processor 125 and other elements of device 120 for implementing a speech dialog system 200. Note processing 200 is shown for illustrative purposes only, and is not meant to restrict the scope of the present disclosure to any particular sequence or set of operations shown in FIG. 2. For example, in alternative exemplary embodiments, certain techniques for performing text-to-speech conversion having a given emotion type may be applied independently of the processing 200 shown in FIG. 2. For example, techniques disclosed herein may be applied in any scenario wherein a script and an emotion type are specified. Furthermore, one or more blocks shown in FIG. 2 may be combined or omitted depending on specific functional partitioning in the system, and therefore FIG. 2 is not meant to suggest any functional dependence or independence of the blocks shown. In alternative exemplary embodiments, the sequence of blocks may differ from that shown in FIG. 2. Such alternative exemplary embodiments are contemplated to be within the scope of the present disclosure.

In FIG. 2, speech recognition 210 is performed on speech input 122. Speech input 122 may be derived, e.g., from microphone 124 on device 120, and may correspond to, e.g., audio waveforms as received from microphone 124.

Speech recognition 210 generates a text rendition of spoken words in speech input 122. Techniques for speech recognition may utilize, e.g., Hidden Markov Models (HMM's) having statistical parameters trained from text databases.

Language understanding 220 is performed on the output of speech recognition 210. In an exemplary embodiment, functions such as parsing and grammatical analysis may be performed to derive the intended meaning of the speech according to natural language understanding techniques.

Emotion response decision 230 generates a suitable emotional response to the user's speech input as determined by language understanding 220. For example, if it is determined that the user's speech input calls for a "happy" emotional response by dialog system 200, then output emotion decision 230 may specify an emotion type 230*a* corresponding to "happy."

Output script generation 240 generates a suitable output script 240*a* in response to the user's speech input 220*a* as determined by language understanding 220, and also based on the emotion type 230*a* determined by emotion response decision 230. Output script generation 240 presents the generated response script 240*a* in a natural language format, e.g., obeying lexical and grammatical rules, for ready comprehension by the user. Output script 240*a* of script generation 240 may be in the form of, e.g., sentences in a target language conveying an appropriate response to the user in a natural language format.

Text-to-speech (TTS) conversion 250 synthesizes speech output 126 having textual content as determined by output script 240*a*, and emotional content as determined by emotion type 230*a*. Speech output 126 of text-to-speech conversion 250 may be an audio waveform, and may be provided to a listener, e.g., user 110 in FIG. 1, via a codec (not shown in FIG. 2), speaker 128 of device 120, and/or other elements.

As mentioned hereinabove, it is desirable in certain applications for speech output 126 to be generated not only as an emotionally neutral rendition of text, but further for speech output 126 to convey specific emotional content to user 110. Techniques for generating artificial speech with emotional content rely on text recordings of speakers delivering speech with the pre-specified emotion type, or otherwise require full speech models to be trained for each emotion type, leading to prohibitive storage requirements for the models and also limited range of emotional output expression. Accordingly, it would be desirable to provide efficient and effective techniques for text-to-speech conversion with emotional content.

Figure 3:
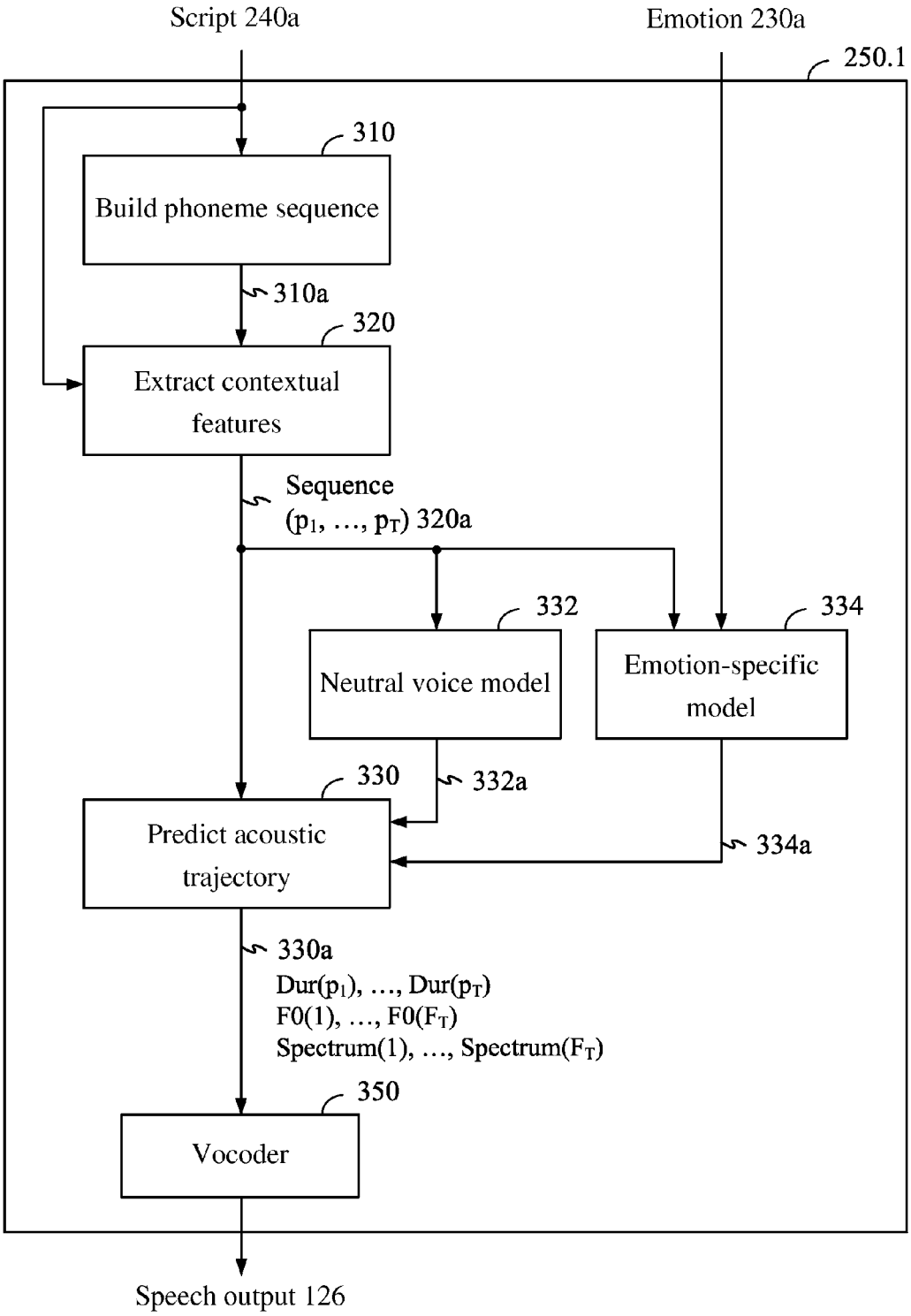
FIG. 3 illustrates an exemplary embodiment of text-to-speech (TTS) conversion techniques for generating speech output having pre-specified emotion type.

FIG. 3 illustrates an exemplary embodiment 250.1 of text-to-speech (TTS) conversion 250 with emotional content. Note FIG. 3 is shown for illustrative purposes only, and is not meant to limit the scope of the present disclosure to any particular exemplary embodiments of text-to-speech conversion.

In FIG. 3, script 240*a* is input to block 310 of TTS conversion 250.1, which builds a phoneme sequence 310*a* from script 240*a*. In particular, block 310 may construct phoneme sequence 310*a* to correspond to the pronunciation of text found in script 240*a*.

At block 320, contextual features are further extracted from script 240*a* to modify phoneme sequence 310*a* and generate linguistic-contextual feature sequence 320*a* as $(p_1, \ldots, p_t, \ldots, p_T)$, wherein $p_t$ represents a feature in sequence from t=1 to T. For example, adjustments to the phoneme sequence 310*a* may be made at block 320 to account for speech variations due to phonetic and linguistic contextual features of the script, thereby generating linguistic-contextual feature sequence 320*a*. Note the sequence 320*a* may be based on both the identity of each phoneme as well as other contextual information such as the part of speech of the word each phoneme belongs to, the number of syllables of the previous word the current phoneme belongs to, etc. Accordingly, each element of the sequence 320*a* may generally be referred to herein as a "linguistic-contextual" phoneme.

Sequence 320*a* is provided to block 330, wherein the acoustic trajectory 330*a* of sequence 320*a* is predicted. In particular, the acoustic trajectory 330*a* specifies a set of acoustic parameters for sequence 320*a* including duration (Dur), fundamental frequency or pitch (F0), and spectrum (Spectrum, or spectral coefficients). In an exemplary embodiment, $\mathrm{Dur}(p_t)$ may be specified for each feature in sequence 320*a*, while F0(*f*) and Spectrum(f) may be specified for each frame f of $F_t$ frames for feature $p_t$. In an exemplary embodiment, a duration model predicts how many frames each state of a phoneme may last. Sequences of acoustic parameters in acoustic trajectory 330*a* are subsequently provided to vocoder 350, which may synthesize a speech waveform corresponding to speech output 126.

As shown in FIG. 3, prediction of the acoustic trajectory at block 330 is performed with reference to both neutral voice model 332 and emotion-specific model 334. In particular, to generate acoustic parameters in acoustic trajectory 330*a*, sequence 320*a* may be specified to neutral voice model 332. Neutral voice model 332 may return acoustic and/or model parameters 332*a* corresponding to an emotionally neutral rendition of sequence 320*a*. In an exemplary embodiment, the acoustic parameters may be derived from model parameters based on statistical parametric speech synthesis techniques.

One such technique includes Hidden Markov Model (HMM)-based speech synthesis, in which speech output is modeled as a plurality of states characterized by statistical parameters such as initial state probabilities, state transition probabilities, and state output probabilities. The statistical parameters of an HMM-based implementation of neutral voice model 332 may be derived from training the HMM to model speech samples found in one or more speech databases having known speech content. The statistical parameters may be stored in a memory (not shown in FIG. 3) for retrieval during speech synthesis.

In an exemplary embodiment, emotion-specific model 334 generates emotion-specific adjustments 334*a* that are applied to parameters obtained from neutral voice model 332 to adapt the synthesized speech to have characteristics of given emotion type 230*a*. In particular, emotion-specific adjustments 334*a* may be derived from training models based on speech samples having pre-specified emotion type found in one or more speech databases having known speech content and emotion type. In an exemplary embodiment, emotion-specific adjustments 334*a* are provided as adjustments to the output parameters 332*a* of neutral voice model 332, rather than as emotion-specific statistical or acoustic parameters independently sufficient to produce an acoustic trajectory for each emotion type. As such adjustments will generally require less memory to store than independently sufficient emotion-specific parameters, memory resources can be conserved when generating speech with pre-specified emotion type according to the present disclosure. In an exemplary embodiment, emotion-specific adjustments 334*a* can be trained and stored separately for each emotion type designated by the system.

In an exemplary embodiment, emotion-specific adjustments 334*a* can be stored and applied to neutral voice model 332 on, e.g., a per-phoneme, per-state, or per-frame basis. For example, in an exemplary embodiment, for a phoneme HMM having three states, three emotion-specific adjustments 334*a* can be stored and applied for each phoneme on a per-state basis. Alternatively, if each state of the three-state phoneme corresponds to two frames, e.g., each frame having duration of 10 milliseconds, then six emotion-specific adjustments 334*a* can be stored and applied for each phoneme of a per-frame basis. Note an acoustic or model parameter may generally be adjusted distinctly for each individual phoneme based on the emotion type, depending on the emotion-specific adjustments 334*a* specified by emotion-specific model 334.

Figure 4:
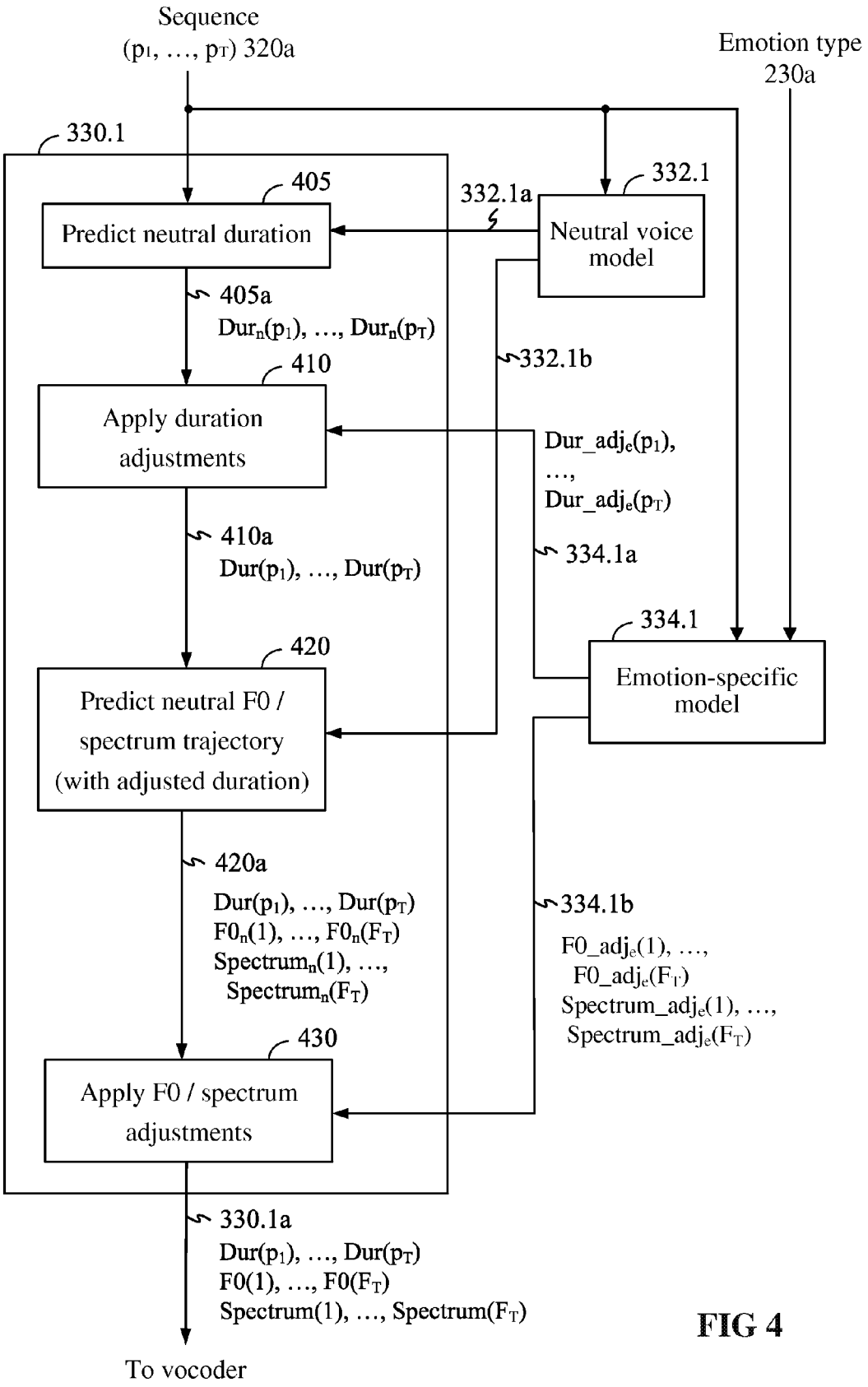
FIG. 4 illustrates an exemplary embodiment of a block in FIG. 3, wherein a neutral acoustic trajectory is modified using emotion-specific adjustments.

FIG. 4 illustrates an exemplary embodiment 330.1 of block 330 in FIG. 3 wherein neutral acoustic parameters are adapted using emotion-specific adjustments. Note FIG. 4 is shown for illustrative purposes only, and is not meant to limit the scope of the present disclosure to the application of emotion-specific adjustments to acoustic parameters only.

In FIG. 4, sequence 320*a* is input to block 410 for predicting the neutral acoustic trajectory of sequence 320*a*. In particular, sequence 320*a* is specified to neutral voice model 332.1. Sequence 320*a* is further specified to emotion-specific model 334.1, along with emotion type 230*a*. Based on duration parameters 332.1*a* of neutral voice model 332.1, neutral durations $\mathrm{Dur}_n(p_t)$ or 405*a* are predicted for sequence 320*a*. Note each acoustic parameter associated with a single state s of phoneme $p_t$ may generally be a vector, e.g., in a three-state-per-phoneme model, $\mathrm{Dur}_n(p_t)$ may denote a vector of three state durations associated with the t-th emotionally neutral phoneme, etc.

Emotion-specific model 334.1 generates duration adjustment parameters $\mathrm{Dur_adj}_e(p_1), \ldots, \mathrm{Dur_adj}_e(p_T)$ or 334.1*a* specific to the emotion type 230*a* and sequence 320*a*. Duration adjustments block 410 applies the duration adjustment parameters 334.1*a* to neutral durations 405*a* to generate the adjusted duration sequence $\mathrm{Dur}(p_1), \ldots, \mathrm{Dur}(p_T)$ or 410*a*.

Based on adjusted duration sequence 410*a*, neutral trajectories 420*a* for F0 and Spectrum is predicted at block 420. In particular, neutral acoustic trajectory 420*a* includes predictions for acoustic parameters $\mathrm{F0}_n(f)$ and $\mathrm{Spectrum}_n(f)$ based on F0 and spectrum parameters 332.1*b* of neutral voice model 332.1, as well as adjusted duration parameters $\mathrm{Dur}(p_1), \ldots, \mathrm{Dur}(p_T)$ derived earlier from 410*a*.

At block 430, emotion-specific F0 and spectrum adjustments 334.1*b* are applied to the corresponding neutral F0 and spectrum parameters of 420*a*. In particular, F0 and spectrum adjustments $\mathrm{F0_adj}_e(1), \ldots, \mathrm{F0_adj}_e(F_T)$, $\mathrm{Spectrum_adj}(1), \ldots, \mathrm{Spectrum_adj}(F_T)$ 334.1*b* are generated by emotion-specific model 334.1 based on sequence 320*a* and emotion type 230*a*. The output 330.1*a* of block 430 includes emotion-specific adjusted Duration, F0, and Spectrum parameters.

In an exemplary embodiment, the adjustments applied at blocks 410 and 430 may correspond to the following:

$$\mathrm{Dur}(p_t)=\mathrm{Dur}_n(p_t)+\mathrm{Dur_adj}_e(p_t); \quad \text{(Equation 1)}$$

$$F0(f)=F0_n(f)+F0_\mathrm{adj}_e(f); \quad \text{(Equation 2) and}$$

$$\mathrm{Spectrum}(f)=\mathrm{Spectrum}_n(f)+\mathrm{Spectrum_adj}_e(f); \quad \text{(Equation 3)}$$

wherein, e.g., Equation 1 may be applied by block 410, and Equations 2 and 3 may be applied by block 430. The resulting acoustic parameters 330.1*a*, including $\mathrm{Dur}(p_t)$, F0(f), and Spectrum(f), may be provided to a vocoder for speech synthesis.

It is noted that in the exemplary embodiment described by Equations 1-3, the emotion-specific adjustments are applied as additive adjustment factors to be combined with the neutral acoustic parameters during speech synthesis. It will be appreciated that in alternative exemplary embodiments, emotion-specific adjustments may readily be stored and/or applied in alternative manners, e.g., multiplicatively, using affine transformation, non-linearly, etc. Such alternative exemplary embodiments are contemplated to be within the scope of the present disclosure.

It is further noted that while duration adjustments are shown as being applied on a per-phoneme basis in Equation 1, and F0 and Spectrum adjustments are shown as being applied on a per-frame basis in Equations 2 and 3, it will be appreciated that alternative exemplary embodiments can adjust any acoustic parameters on any per-state, per-phoneme, or per-frame bases. Such alternative exemplary embodiments are contemplated to be within the scope of the present disclosure.

Figure 5:
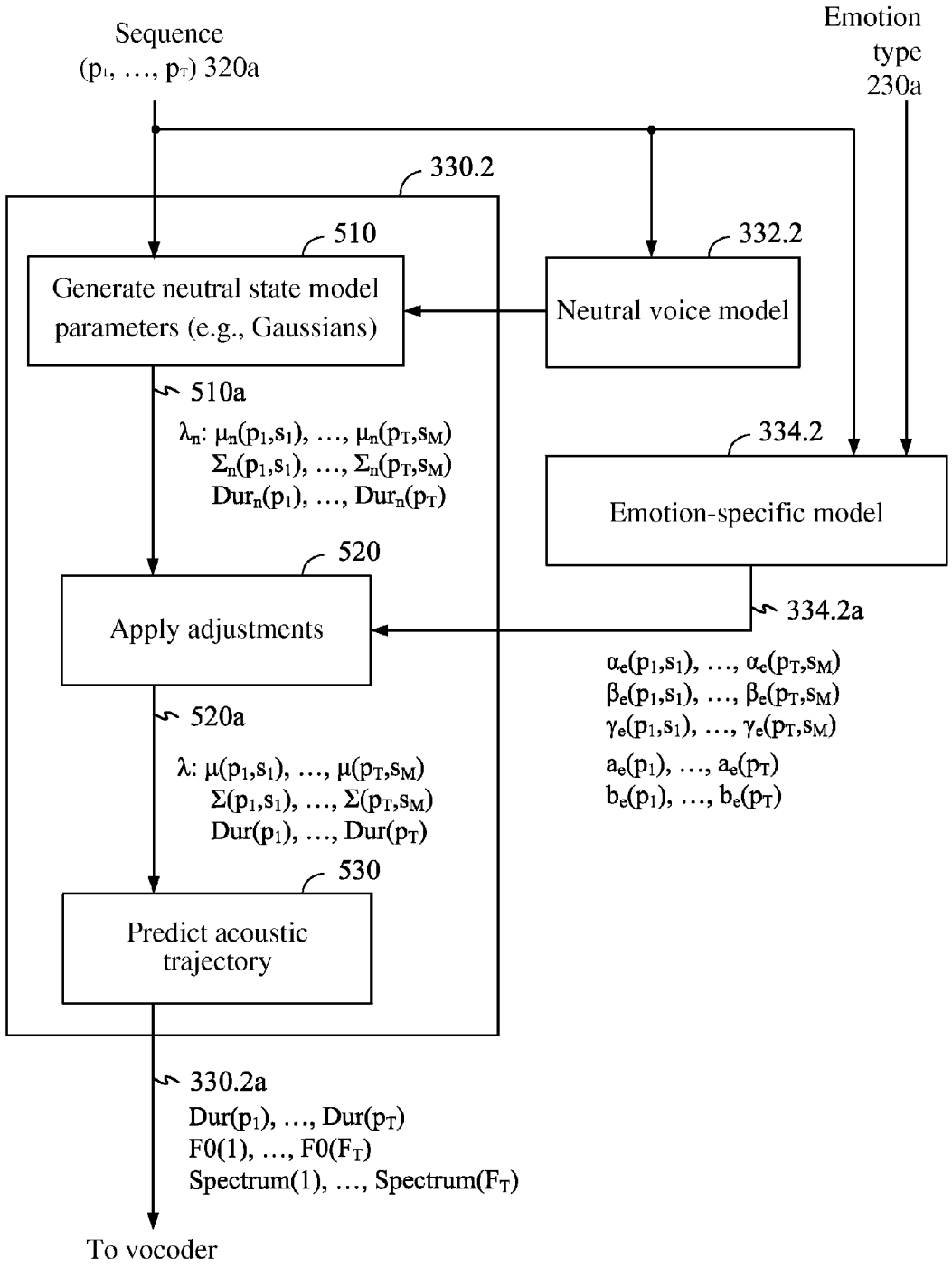
FIG. 5 illustrates an exemplary embodiment of a block in FIG. 3, wherein neutral HMM state model parameters are adapted using emotion-specific adjustments.

FIG. 5 illustrates an alternative exemplary embodiment 330.2 of block 330 in FIG. 3, wherein neutral HMM state parameters are adapted using emotion-specific adjustments. Note FIG. 5 is shown for illustrative purposes only, and is not meant to limit the scope of the present disclosure to emotion-specific adaptation of HMM state parameters.

In FIG. 5, block 510 generates a neutral HMM sequence 510*a* constructed from sequence 320*a* using a neutral voice model 332.2. The neutral HMM sequence 510*a* specifies per-state model parameters of a neutral HMM (denoted $\lambda_n$), including a sequence of mean vectors $\mu_n(p_1,s_1), \ldots, \mu_n(p_t,s_m), \ldots, \mu_n(p_T,s_M)$ associated with the states of each phoneme, and a corresponding sequence of covariance matrices $\Sigma_n(p_1, s_1), \ldots, \Sigma_n(p_t, s_m), \ldots, \Sigma_n(p_T,s_M)$, wherein $(p_t,s_m)$ denotes the m-th state (of M states, wherein M may depend on the phoneme) of the $p_t$-th phoneme. Neutral HMM sequence 510*a* further specifies neutral per-phoneme durations $Dur_n(p_1), \ldots, Dur_n(p_T)$. In an exemplary embodiment, each mean vector $\mu_n(p_t,s_m)$ may include as elements the mean values of a spectral portion (e.g., Spectrum) of an observation vector of the corresponding state, including $c_t$ (static feature coefficients, e.g., mel-cepstral coefficients), $\Delta c_t$ (first-order dynamic feature coefficients), and $\Delta^2 c_t$ (second-order dynamic feature coefficients), while each covariance matrix $\Sigma_n(p_t,s_m)$ may specify the covariance of those features.

Sequence 320*a* is further specified as input to emotion-specific model 334.2, along with emotion type 230*a*. The output 334.2*a* of emotion-specific model 334.2 specifies emotion-specific model adjustment factors. In an exemplary embodiment, the adjustment factors 334.2*a* include model adjustment factors $\alpha_e(p_1,s_1), \ldots, \alpha_e(p_T,s_M)$, $\beta_e(p_1,s_1), \ldots, \beta_e(p_T,s_M)$, $\gamma_e(p_1,s_1), \ldots, \gamma_e(p_T,s_M)$ specified on a per-state basis, as well as emotion-specific duration adjustment factors $a_e(p_1), \ldots, a_e(p_T)$, $b_e(p_1), \ldots, b_e(p_T)$, on a per-phoneme basis.

Block 520 applies emotion-specific model adjustment factors 334.2*a* specified by block 334.2 to corresponding parameters of the neutral HMM $\lambda_n$ to generate an output 520*a*. In an exemplary embodiment, the adjustments may be applied as follows:

$$\mu(p_t,s_m)=\alpha_e(p_t,s_m)\mu_n(p_t,s_m)+\beta_e(p_t,s_m); \quad \text{(Equation 4)}$$

$$\Sigma(p_t,s_m)=\gamma_e(p_t,s_m)\Sigma_n(p_t,s_m); \quad \text{(Equation 5) and}$$

$$Dur(p_t)=a_e(p_t)Dur_n(p_t)+b_e(p_t); \quad \text{(Equation 6)}$$

wherein $\mu(p_t,s_m)$, $\mu_n(p_t,s_m)$, and $\beta_e(p_t,s_m)$ are vectors, $\alpha_e(p_t,s_m)$ is a matrix, and $\alpha_e(p_t,s_m)\ \mu_n(p_t,s_m)$ represents left-multiplication of $\mu_n(p_t,s_m)$ by $\alpha_e(p_t,s_m)$, while $\Sigma(p_t,s_m)$, $\gamma_e(p_t,s_m)$, and $\Sigma_n(p_t,s_m)$ are all matrices, and $\gamma_e(p_t,s_m)\ \Sigma_n(p_t,s_m)$ represents left-multiplication of $\Sigma_n(p_t,s_m)$ by $\gamma_e(p_t,s_m)$. It will be appreciated that the adjustments of Equations 4 and 6 effectively apply affine transformations (i.e., a linear transformation along with addition by a constant) to the neutral mean vector $\mu_n(p_t,s_m)$ and duration $Dur_n(p_t)$ to generate new model parameters $\mu(p_t,s_m)$ and $Dur(p_t)$. In this Specification and in the claims, $\mu(p_t,s_m)$, $\Sigma(p_t,s_m)$, and $Dur(p_t)$ are generally denoted the "transformed" model parameters. Note alternative exemplary embodiments need not apply affine transformations to generate the transformed model parameters, and other transformations such as non-linear transformations may also be employed. Such alternative exemplary embodiments are contemplated to be within the scope of the present disclosure.

Based on the transformed model parameters, the acoustic trajectory (e.g., F0 and spectrum) may subsequently be predicted at block 530, and predicted acoustic trajectory 330.2*a* is output to the vocoder to generate the speech waveform. Based on choice of the emotion-specific adjustment factors, it will be appreciated that acoustic parameters 330.2*a* are effectively adapted to generate speech having emotion-specific characteristics.

In an exemplary embodiment, clustering techniques may be used to reduce the memory resources required to store emotion-specific state model or acoustic parameters, as well as enable estimation of model parameters for states wherein training data is unavailable or sparse. In an exemplary embodiment employing decision tree clustering, a decision tree may be independently built for each emotion type to cluster emotion-specific adjustments. It will be appreciated that providing independent emotion-specific decision trees in this manner may more accurately model the specific prosody characteristics associated with a target emotion type, as the questions used to cluster emotion-specific states may be specifically chosen and optimized for each emotion type. In an exemplary embodiment, the structure of an emotion-specific decision tree may be different from the structure of a decision tree used to store neutral model or acoustic parameters.

Figure 6:
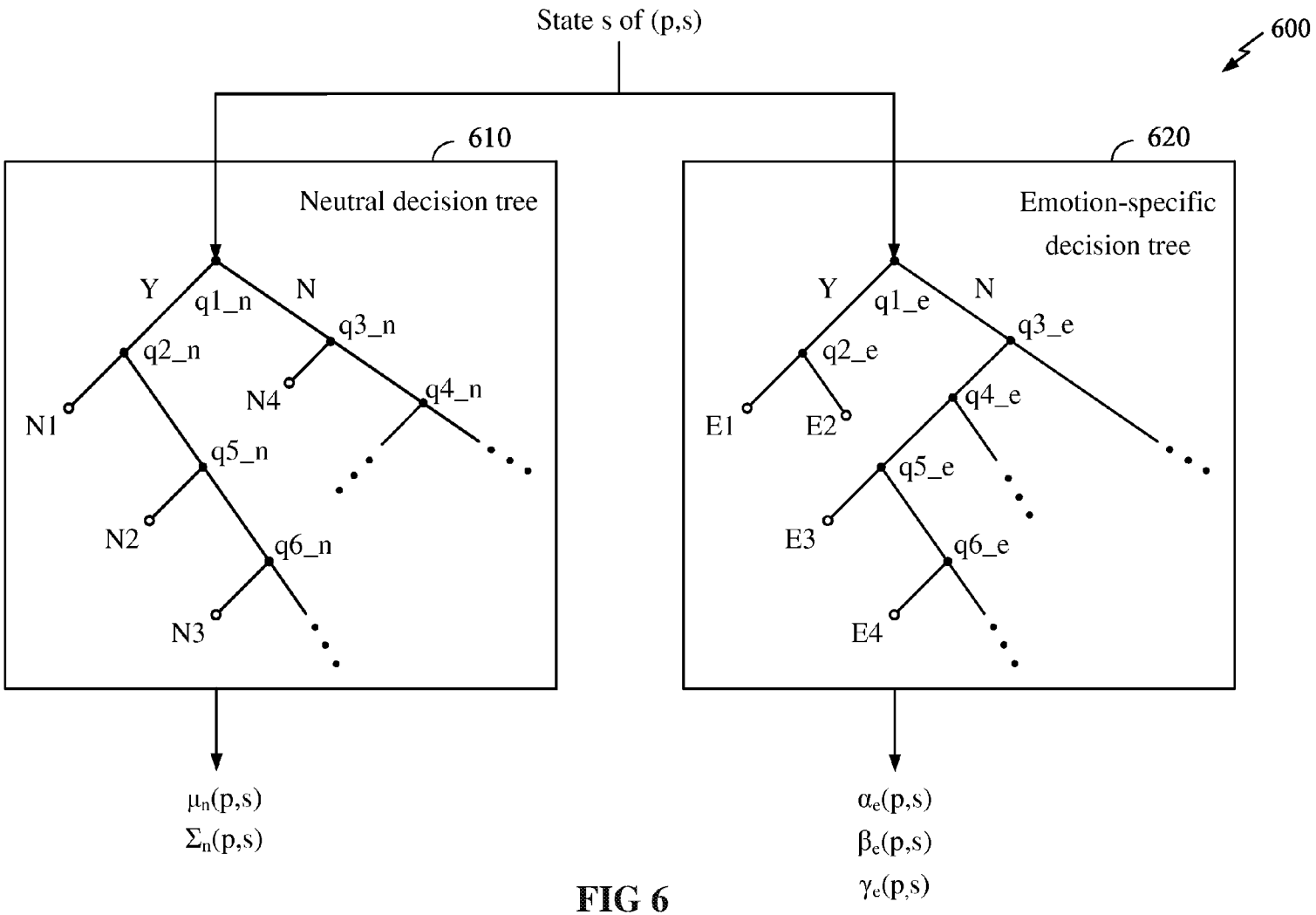
FIG. 6 illustrates an exemplary embodiment of decision tree clustering according to the present disclosure.

FIG. 6 illustrates an exemplary embodiment 600 of decision tree clustering according to the present disclosure. It will be appreciated that FIG. 6 is shown for illustrative purposes only, and is not meant to limit the scope of the present disclosure to any particular structure or other characteristics for the decision trees shown. Furthermore, FIG. 6 is not meant to limit the scope of the present disclosure to only decision tree clustering for clustering the model parameters shown, as other parameters such as emotion-specific adjustment values for F0, Spectrum, or Duration may readily be clustered using decision tree techniques. FIG. 6 is further not meant to limit the scope of the present disclosure to the use of decision trees for clustering, as other clustering techniques such as Conditional Random Fields (CRF's), Artificial Neural Networks (ANN's), etc., may also be used. For example, in an alternative exemplary embodiment, each emotion type may be associated with a distinct CRF. Such alternative exemplary embodiments are contemplated to be within the scope of the present disclosure.

In FIG. 6, the state s of a phoneme indexed by (p,s) is provided to two independent decision trees: neutral decision tree 610 and emotion-specific decision tree 620. Neutral decision tree 610 categorizes state s into one of a plurality of neutral leaf nodes N1, N2, N3, etc., based on a plurality of neutral questions q1_n, q2_n, etc., applied to the state s and its context. Associated with each leaf node of neutral decision tree 610 are corresponding model parameters, e.g., Gaussian model parameters specifying a neutral mean vector $\mu_n(p,s)$, neutral covariance matrix $\Sigma_n(p,s)$, etc.

On the other hand, emotion-specific decision tree 620 categorizes state s into one of a plurality of emotion-specific leaf nodes E1, E2, E3, etc., based on a plurality of emotion-specific questions q1_e, q2_e , etc., applied to state s and its context. Associated with each leaf node of emotion-specific decision tree 610 may be corresponding emotion-specific adjustment factors, e.g., $\alpha_e(p,s)$, $\beta_e(p,s)$, $\gamma_e(p,s)$, and/or other factors to be applied to as emotion-specific adjustments, e.g., as specified in Equations 1-6. Note the structure of the emotion-specific leaf nodes and the choice of emotion-specific questions for emotion-specific decision tree 620 may generally be entirely different from the structure of the neutral leaf nodes and choice of neutral questions for neutral decision tree 610, i.e., the neutral and emotions-specific decision trees may be "distinct." The difference in structure of the decision trees allows, e.g., each emotion-specific decision tree to be optimally constructed for a given emotion type to more accurately capture the emotion-specific adjustment factors.

In an exemplary embodiment, each transform decision tree may be constructed based on various criteria for selecting questions, e.g., a series of questions may be chosen to maximize a model auxiliary function such as the weighted sum of log-likelihood functions for the leaf nodes, wherein the weights applied may be based on state occupation probabilities of the corresponding states. Per iterative algorithms known for constructing decision trees, the choosing of questions may proceed and terminate based on a metric such as specified by minimum description length (MDL) or other cross-validation methods.

Figure 7:
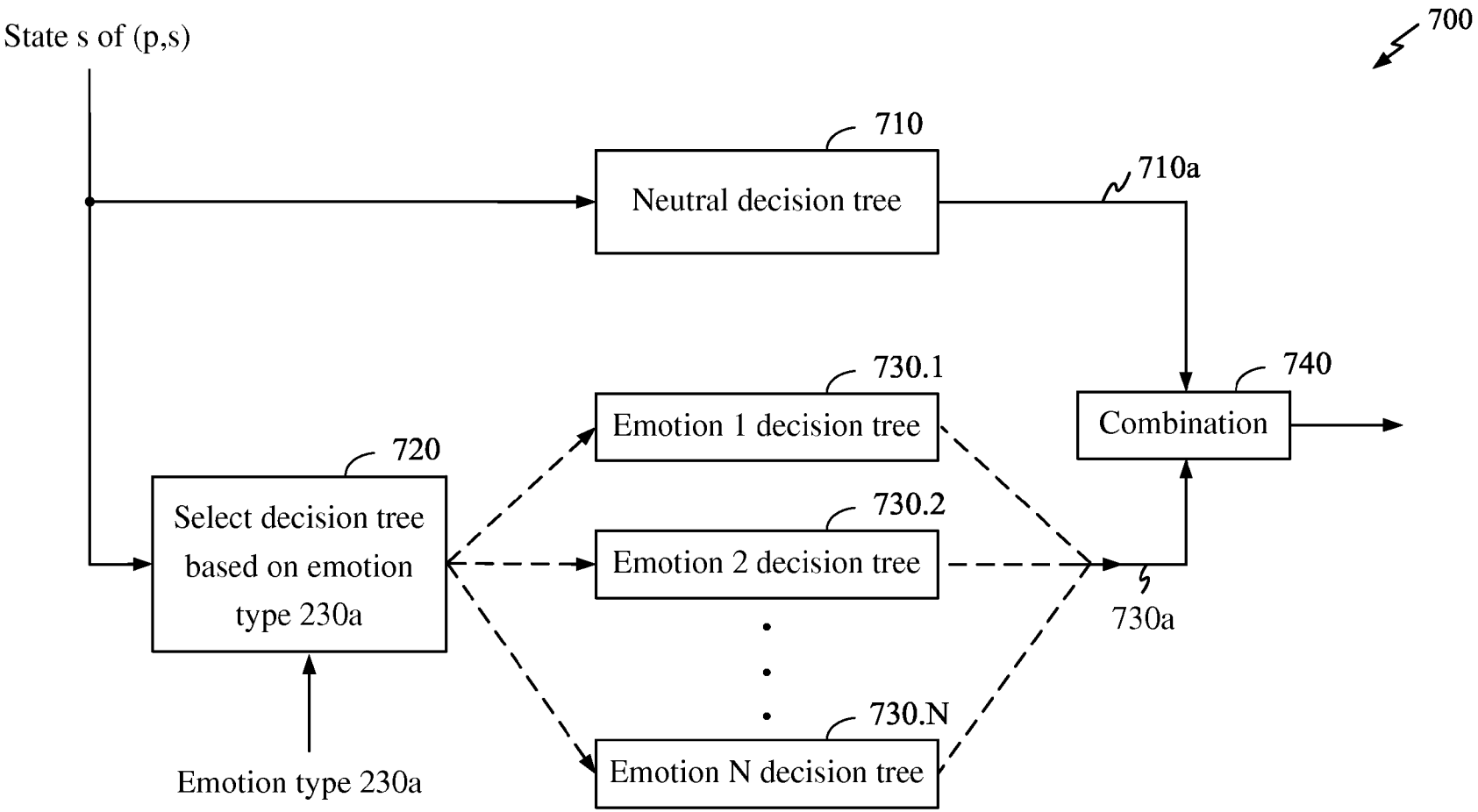
FIG. 7 illustrates an exemplary embodiment of a scheme for storing a separate decision tree for each of a plurality of emotion types that can be specified in a text-to-speech system.

FIG. 7 illustrates an exemplary embodiment 700 of a scheme for storing a separate decision tree for each of a plurality of emotion types that can be specified in a system for synthesizing text to speech having emotional content. It will be appreciated that the techniques shown in FIG. 7 may be applied, e.g., as a specific implementation of blocks 510, 332.2, 334.2, and 520 shown in FIG. 5.

In FIG. 7, the state s of a phoneme indexed by (p,s) is provided to a neutral decision tree 710 and a selection block 720. Neutral decision tree 710 outputs neutral parameters 710*a* for the state s, while selection block 720 selects from a plurality of emotion-specific decision trees 730.1 through 730.N based on the given emotion type 230*a*. For example, Emotion type 1 decision tree 730.1 may store emotion adjustment factors for a first emotion type, e.g., "Joy," while Emotion type 2 decision tree 730.2 may store emotion adjustment factors for a second emotion type, e.g., "Sadness," etc. Each of the emotion-specific decision trees 730.1 may include questions and leaf nodes chosen and constructed with reference to, e.g., emotion-specific decision tree 620 in FIG. 6.

The output of the selected one of the emotion-specific decision trees 730.1 through 730.N is provided as 730*a*, which includes emotion-specific adjustment factors for the given emotion type 230*a*.

Adjustment block 740 applies the adjustment factors 730*a* to the neutral model parameters 710*a*, e.g., as earlier described hereinabove with reference to Equations 4 and 5, to generate the transformed model or acoustic parameters.

Figure 8A:
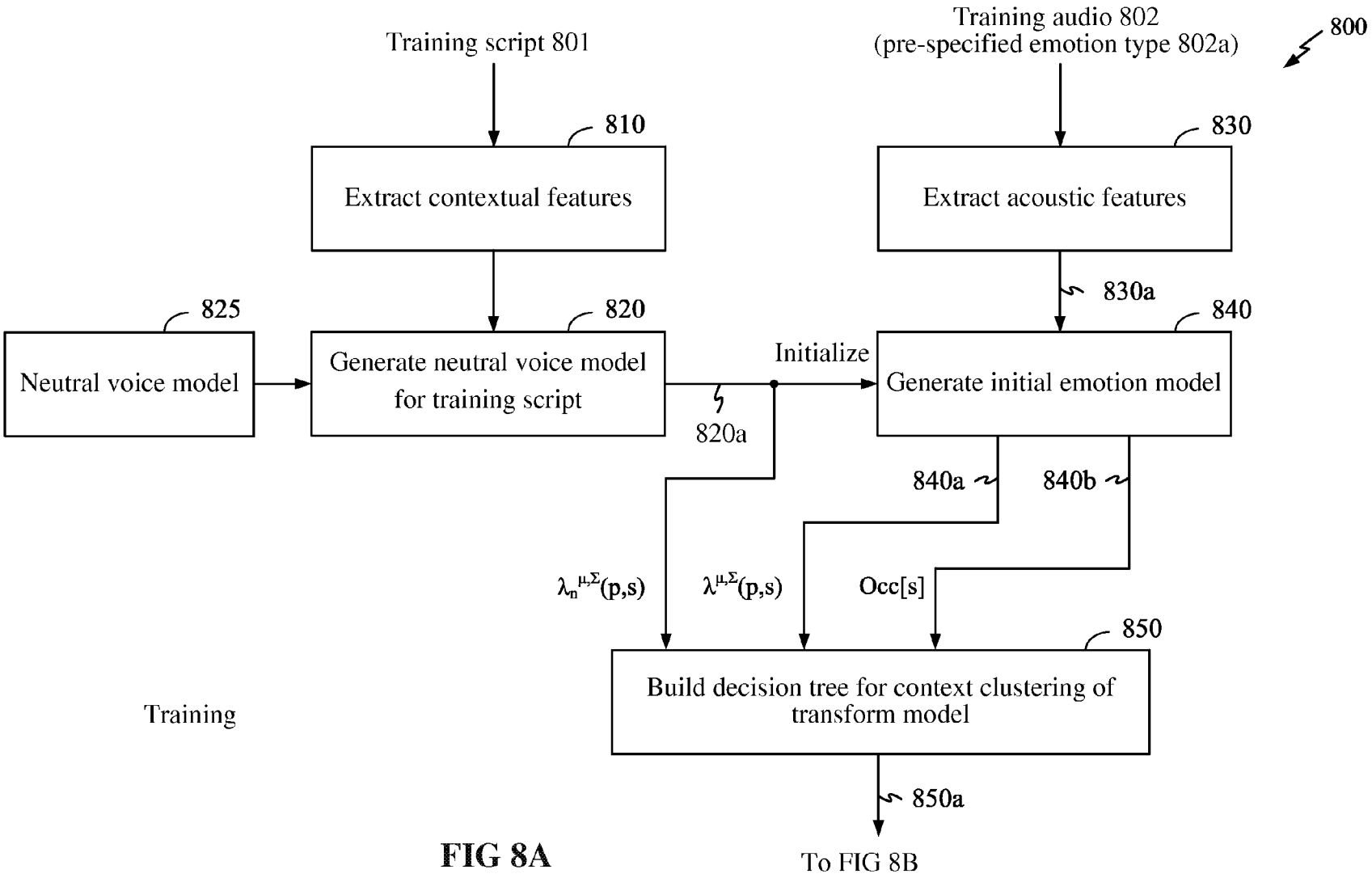
FIGS. 8A and 8B illustrate an exemplary embodiment of techniques to derive emotion-specific adjustment factors according to the present disclosure.
Figure 8B:
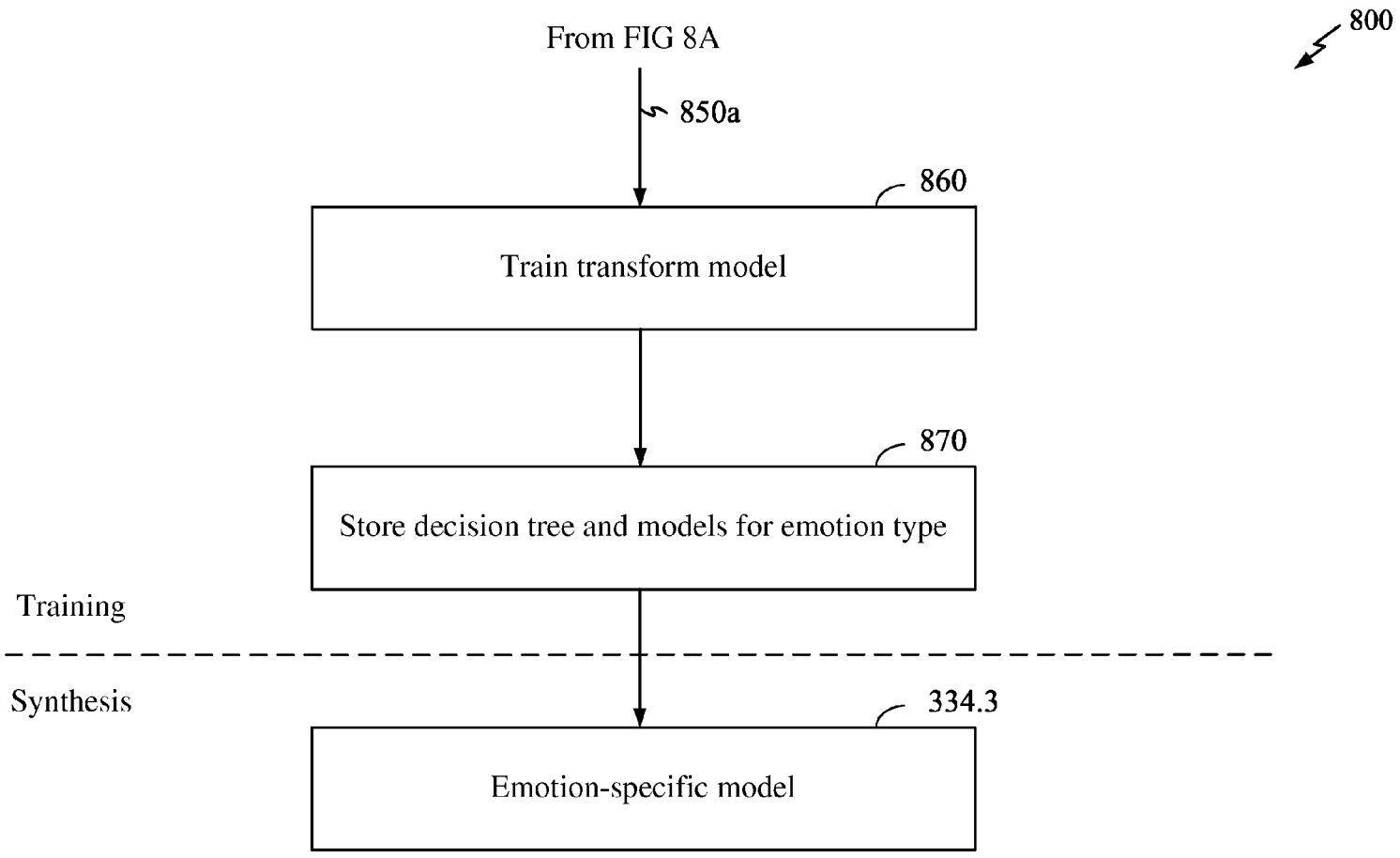

FIGS. 8A and 8B illustrate an exemplary embodiment 800 of techniques to derive emotion-specific adjustment factors for a single emotion type according to the present disclosure. Note FIGS. 8A and 8B are shown for illustrative purposes only, and are not meant to limit the scope of the present disclosure to any particular techniques for deriving emotion-specific adjustment factors. In the description hereinbelow, training audio 802 and training script 801 need not correspond to a single segment of speech, or segments of speech from a single speaker, but rather may correspond to any corpus of speech having a pre-specified emotion type.

In FIG. 8A, training script 801 is provided to block 810, which extracts contextual features from training script 801. For example, the linguistic context of phonemes may be extracted to optimize the state models. At block 820, parameters of a neutral speech model corresponding to training script 801 are synthesized according to an emotionally neutral voice model 825. The output 820*a* of block 820 includes model parameters, e.g., also denoted $\lambda_n^{\mu,\Sigma}(p,s)$, of an emotionally neutral rendition of the text in the training script.

Training audio 802 corresponding to training script 801 is further provided to block 830. Training audio 802 corresponds to a rendition of the text in training script 801 with a pre-specified emotion type 802*a*. Training audio 802 may be generated, e.g., by pre-recording a human speaker instructed to read the training script 801 with the given emotion type 802*a*. From training audio 802, acoustic features 830*a* are extracted at block 830. Examples of acoustic features 830*a* may include, e.g., duration, F0, spectral coefficients, etc.

The extracted acoustic features 830*a* are provided (e.g., as observation vectors) to block 840, which generates a set of parameters for a speech model, also denoted herein as the "initial emotion model," corresponding to training audio 802 with pre-specified emotion type 802*a*. Note block 840 performs analysis on the extracted acoustic features 830*a* to derive the initial emotion model parameters, since block 840 may not directly be provided with the training script 801 corresponding to training audio 802. It will be appreciated that deriving an optimal set of model parameters, e.g., HMM output probabilities and state transition probabilities, etc., for training audio 802 may be performed using, e.g., an iterative procedure such as the expectation-maximization (EM) algorithm (Baum-Welch algorithm) or a maximum likelihood (ML) algorithm. To aid in convergence, the parameter set used to initialize the iterative algorithm at block 840 may be derived from neutral model parameters 820*a*.

Block 840 generates emotion-specific model parameters $\lambda^{\mu,\Sigma}(p,s)$ 840*a*, along with state occupation probabilities 840*b* for each state s, e.g.:

$$\text{Occupation statistic for state } s = \text{Occ}[s] = P(O,s|\lambda^{\mu,\Sigma}(p,s)); \quad \text{(Equation 7)}$$

wherein O represents the total set of observation vectors. In an exemplary embodiment, occupation statistics 840*b* may aid in the generation of a decision tree for the emotion-specific model parameters, as previously described hereinabove.

At block 850, a decision tree is constructed for context clustering of the emotion-specific adjustments. It will be appreciated that in view of the present disclosure, the decision tree may be constructed using any suitable techniques for clustering the emotion-specific adjustments. In an exemplary embodiment, the decision tree may be constructed directly using the emotion-specific model parameters $\lambda^{\mu,\Sigma}(p,s)$ 840*a*. In an alternative exemplary embodiment, the decision tree may be constructed using a version of the transformed model, e.g., by applying the equations specified in Equations 4-6 hereinabove to the parameters of neutral model $\lambda_n^{\mu,\Sigma}(p,s)$ 820*a* to generate transformed model parameters. In such an exemplary embodiment, the corresponding adjustment factors (e.g., $\alpha_e(p_t,s_m)$, $\beta(p_t,s_m)$, and $\gamma_e(p,s)$, as well as duration adjustments) to be applied for the transformation may be estimated by applying linear regression techniques to obtain a best linear fit of transformed parameters of neutral model $\lambda_n^{\mu,\Sigma}(p,s)$ 820*a* to the emotion-specific model $\lambda^{\mu,\Sigma}(p,s)$ 840*a*, as necessary.

It will be appreciated that construction of the decision tree (based on, e.g., the emotion-specific model or the transformed model) may proceed by, e.g., selecting appropriate questions to maximize the weighted sum of the log-likelihood ratios of the leaf nodes of the tree. In an exemplary embodiment, the weights applied in the weighted sum may include the occupancy statistics Occ[s] 840*b*. The addition of branches and leaf nodes may proceed until terminated based on a metric, e.g., such as specified by minimum description length (MDL) or other cross-validation techniques.

Referring to FIG. 8B, which is the continuation of FIG. 8A, the output 850*a* of block 850 specifies a decision tree including a series of questions q1_t, q2_t, q3_t, etc., for clustering the states s of (p,s) into a plurality of leaf nodes. Such output 850*a* is further provided to training block 860, which derives a single set of adjustment factors, e.g., $\alpha_e(p_t, s_m)$, $\beta_e(p_t,s_m)$, $\gamma_e(p,s)$, and duration adjustments, for each leaf node of the decision tree. In an exemplary embodiment, the single set of adjustment factors may be generated using maximum likelihood linear regression (MLLR) techniques, e.g., by optimally fitting neutral model parameters of the leaf node states to the corresponding emotional model parameters using affine or linear transformations.

At block 870, the structure of the constructed decision tree and the adjustment factors for each leaf node are stored in memory, e.g., for later use as emotion-specific model 334.3. Storage of this information in memory at block 870 completes the training phase. During speech synthesis, e.g., per the exemplary embodiment shown in FIG. 5, emotion-specific adjustments may retrieve from memory the adjustment factors stored at block 870 of the training phase as emotion-specific model 334.3.

Figure 9:
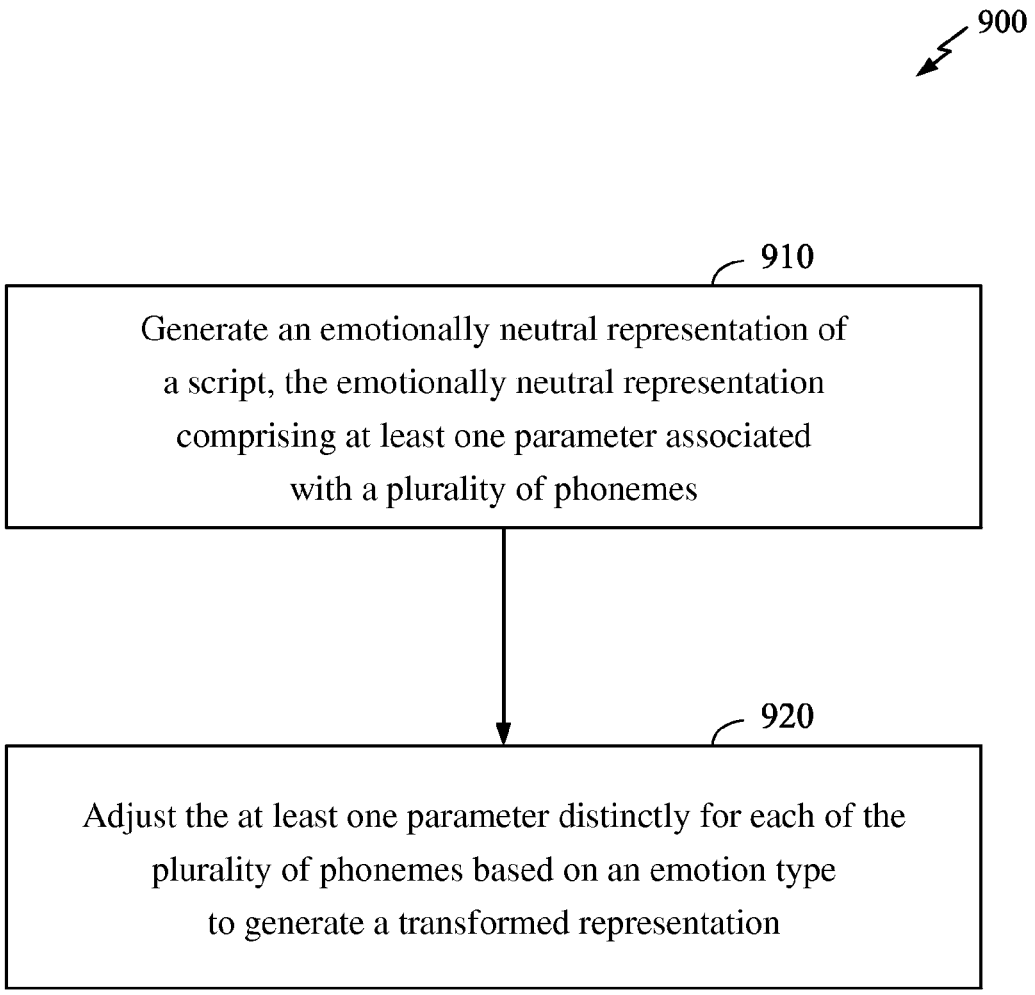
FIG. 9 illustrates an exemplary embodiment of a method according to the present disclosure.

FIG. 9 illustrates an exemplary embodiment of a method 900 according to the present disclosure. Note FIG. 9 is shown for illustrative purposes only, and is not meant to limit the scope of the present disclosure to any particular method shown.

In FIG. 9, at block 910, an emotionally neutral representation of a script is generated. The emotionally neutral representation may include at least one parameter associated with a plurality of phonemes.

At block 920, the at least one parameter is adjusted distinctly for each of the plurality of phonemes based on an emotion type to generate a transformed representation.

Figure 10:
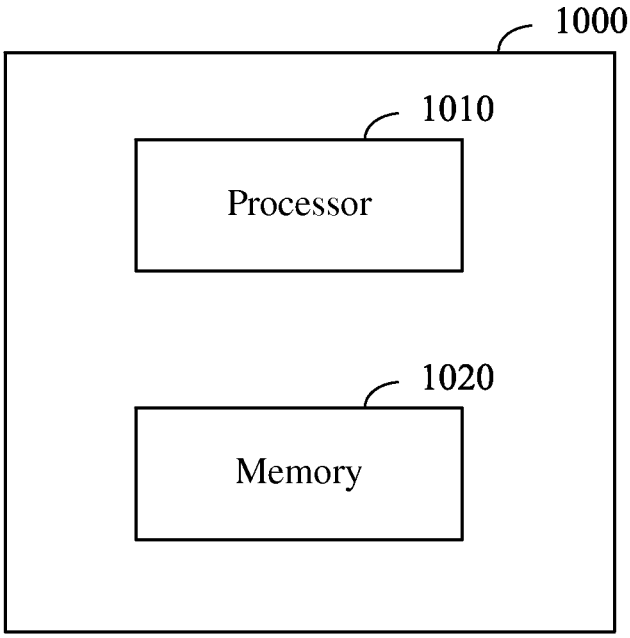
FIG. 10 schematically shows a non-limiting computing system that may perform one or more of the above described methods and processes.

FIG. 10 schematically shows a non-limiting computing system 1000 that may perform one or more of the above described methods and processes. Computing system 1000 is shown in simplified form. It is to be understood that virtually any computer architecture may be used without departing from the scope of this disclosure. In different embodiments, computing system 1000 may take the form of a mainframe computer, server computer, desktop computer, laptop computer, tablet computer, home entertainment computer, network computing device, mobile computing device, mobile communication device, smartphone, gaming device, etc.

Computing system 1000 includes a processor 1010 and a memory 1020. Computing system 1000 may optionally include a display subsystem, communication subsystem, sensor subsystem, camera subsystem, and/or other components not shown in FIG. 10. Computing system 1000 may also optionally include user input devices such as keyboards, mice, game controllers, cameras, microphones, and/or touch screens, for example.

Processor 1010 may include one or more physical devices configured to execute one or more instructions. For example, the processor may be configured to execute one or more instructions that are part of one or more applications, services, programs, routines, libraries, objects, components, data structures, or other logical constructs. Such instructions may be implemented to perform a task, implement a data type, transform the state of one or more devices, or otherwise arrive at a desired result.

The processor may include one or more processors that are configured to execute software instructions. Additionally or alternatively, the processor may include one or more hardware or firmware logic machines configured to execute hardware or firmware instructions. Processors of the processor may be single core or multicore, and the programs executed thereon may be configured for parallel or distributed processing. The processor may optionally include individual components that are distributed throughout two or more devices, which may be remotely located and/or configured for coordinated processing. One or more aspects of the processor may be virtualized and executed by remotely accessible networked computing devices configured in a cloud computing configuration.

Memory 1020 may include one or more physical devices configured to hold data and/or instructions executable by the processor to implement the methods and processes described herein. When such methods and processes are implemented, the state of memory 1020 may be transformed (e.g., to hold different data).

Memory 1020 may include removable media and/or built-in devices. Memory 1020 may include optical memory devices (e.g., CD, DVD, HD-DVD, Blu-Ray Disc, etc.), semiconductor memory devices (e.g., RAM, EPROM, EEPROM, etc.) and/or magnetic memory devices (e.g., hard disk drive, floppy disk drive, tape drive, MRAM, etc.), among others. Memory 1020 may include devices with one or more of the following characteristics: volatile, nonvolatile, dynamic, static, read/write, read-only, random access, sequential access, location addressable, file addressable, and content addressable. In some embodiments, processor 1010 and memory 1020 may be integrated into one or more common devices, such as an application specific integrated circuit or a system on a chip.

Memory 1020 may also take the form of removable computer-readable storage media, which may be used to store and/or transfer data and/or instructions executable to implement the herein described methods and processes. Removable computer-readable storage media 1030 may take the form of CDs, DVDs, HD-DVDs, Blu-Ray Discs, EEPROMs, and/or floppy disks, among others.

It is to be appreciated that memory 1020 includes one or more physical devices that stores information. The terms "module," "program," and "engine" may be used to describe an aspect of computing system 1000 that is implemented to perform one or more particular functions. In some cases, such a module, program, or engine may be instantiated via processor 1010 executing instructions held by memory 1020. It is to be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program," and "engine" are meant to encompass individual or groups of executable files, data files, libraries, drivers, scripts, database records, etc.

In an aspect, computing system 1000 may correspond to a computing device including a memory 1020 holding instructions executable by a processor 1010 to generate an emotionally neutral representation of a script, the emotionally neutral representation including at least one parameter associated with a plurality of phonemes. The memory 1020 may further hold instructions executable by processor 1010 to adjust the at least one parameter distinctly for each of the plurality of phonemes based on an emotion type to generate a transformed representation. Note such a computing device will be understood to correspond to a process, machine, manufacture, or composition of matter.

Figure 11:
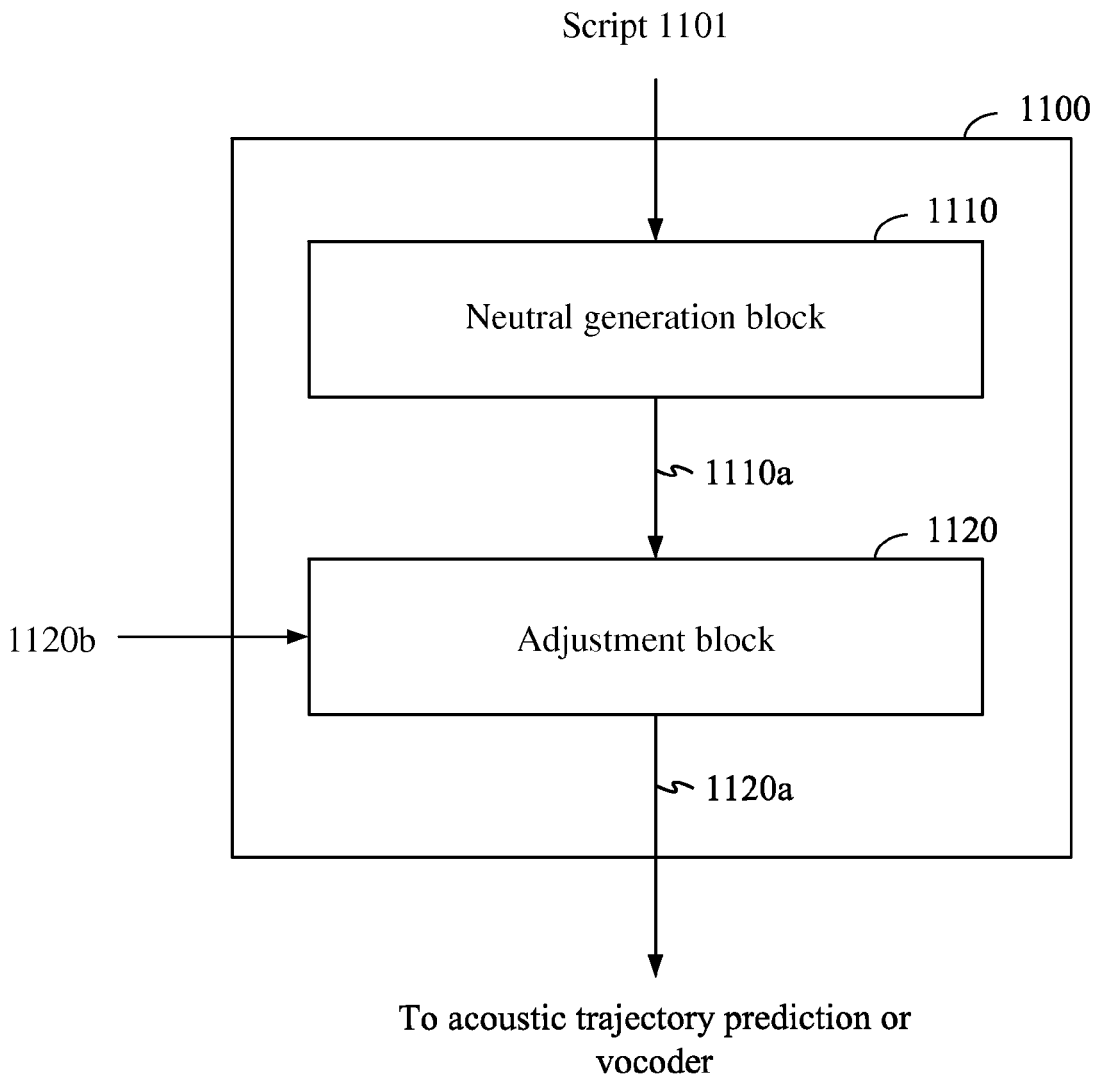
FIG. 11 illustrates an exemplary embodiment of an apparatus for text-to-speech conversion according to the present disclosure.

FIG. 11 illustrates an exemplary embodiment 1100 of an apparatus for text-to-speech conversion according to the present disclosure. In FIG. 11, a neutral generation block 1110 is configured to generate an emotionally neutral representation **1110*a* of a script 1101. The emotionally neutral representation 1110*a* includes at least one parameter associated with a plurality of phonemes. In an exemplary embodiment, the at least one parameter may include any or all of, e.g., a duration of every phoneme of every frame, a fundamental frequency of every frame of every phoneme, a spectral coefficient of every frame, or a statistical parameter (such as a mean vector or covariance matrix) associated with a state of a Hidden Markov Model of every phoneme. In an exemplary embodiment, the neutral generation block 1110** may be configured to retrieve a parameter of the state of an HMM from a neutral decision tree.

An adjustment block 1120 is configured to adjust the at least one parameter in the emotionally neutral representation 1110*a* distinctly for each of the plurality of frames, based on an emotion type 1120*b*. The output of adjustment block 1120 corresponds to the transformed representation 1120*a*. In an exemplary embodiment, adjustment block 1120 may apply, e.g., a linear or affine transformation to the at least one parameter as described hereinabove with reference to, e.g., blocks 440 or 520, etc. The transformed representation may correspond to, e.g., transformed model parameters such as described hereinabove with reference to Equations 4-6, or transformed acoustic parameters such as described hereinabove with reference to Equations 1-3. Transformed representation 1120*a* may be further provided to a block (e.g., block 530 in FIG. 5) for predicting an acoustic trajectory (if transformed representation 1120*a* corresponds to model parameters), or to a vocoder (not shown in FIG. 11) if transformed representation 1120*a* corresponds to an acoustic trajectory.

In an exemplary embodiment, the adjustment block 1120 may be configured to retrieve an adjustment factor corresponding to the state of the HMM from an emotion-specific decision tree.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Furthermore, when an element is referred to as being "electrically coupled" to another element, it denotes that a path of low resistance is present between such elements, while when an element is referred to as being simply "coupled" to another element, there may or may not be a path of low resistance between such elements.

The functionality described herein can be performed, at least in part, by one or more hardware and/or software logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

The invention claimed is:

1. An apparatus for text-to-speech conversion comprising:

a neutral duration prediction block comprising computer hardware configured to generate an emotionally neutral representation of a script, the emotionally neutral representation comprising a neutral duration associated with each of a plurality of phonemes; and a duration adjustment block comprising computer hardware configured to apply a duration adjustment factor to each neutral duration to generate a transformed duration sequence, the duration adjustment factor being dependent on an emotion type and a linguistic-contextual identity of the corresponding phoneme;

a neutral trajectory prediction block comprising computer hardware configured to generate a neutral fundamental frequency (F0) prediction and a neutral spectrum prediction for each adjusted duration of the transformed duration sequence; and a trajectory adjustment block comprising computer hardware configured to apply an F0 adjustment factor to each neutral F0 prediction and a spectrum adjustment factor to each neutral spectrum prediction to generate a transformed representation, each of the F0 adjustment factor and the spectrum adjustment factor being dependent on the emotion type and the linguistic-contextual identity of the corresponding phoneme.

2. The apparatus of claim 1, further comprising a vocoder configured to synthesize a speech waveform from the transformed representation.

3. The apparatus of claim 1, further comprising a memory storing a neutral decision tree and an emotion-specific decision tree distinct from the neutral decision tree, the neutral duration prediction block further configured to retrieve the duration of each phoneme from the neutral decision tree, and the duration adjustment block configured to retrieve an emotion-specific adjustment factor for adjusting each duration of each phoneme from the emotion-specific decision tree.

4. The apparatus of claim 1, further comprising:

a build block configured to build a phoneme sequence based on a text script;

an extract block configured to modify the built phoneme sequence to generate a linguistic-contextual feature sequence based on extracted contextual features of the text script; wherein the plurality of phonemes of the neutral duration prediction block corresponds to the linguistic-contextual feature sequence.

5. The apparatus of claim 1, each of the plurality of phonemes comprising a plurality of states, each of the adjustment factors applied on a per-state basis.

6. The apparatus of claim 5, each of the plurality of phonemes comprising three states.

7. The apparatus of claim 1, each of the plurality of phonemes comprising a plurality of states, each of the adjustment factors applied on a per-frame basis.

8. The apparatus of claim 1, each of the duration adjustment factor, the F0 adjustment factor, and the spectrum adjustment factor being applied additively.

9. The apparatus of claim 1, each of the duration adjustment factor, the F0 adjustment factor, and the spectrum adjustment factor being applied as a linear transformation.

10. The apparatus of claim 1, each of the duration adjustment factor, the F0 adjustment factor, and the spectrum adjustment factor being applied as an affine transformation.

11. A computing device including a memory holding instructions executable by a processor to:

generate an emotionally neutral representation of a script, the emotionally neutral representation comprising a neutral duration associated with each of a plurality of phonemes; and apply a duration adjustment factor to each neutral duration to generate a transformed duration sequence, the duration adjustment factor being dependent on an emotion type and a linguistic-contextual identity of the corresponding phoneme;

generate a neutral fundamental frequency (F0) prediction and a neutral spectrum prediction for each adjusted duration of the transformed duration sequence; and apply an F0 adjustment factor to each neutral F0 prediction and a spectrum adjustment factor to each neutral spectrum prediction to generate a transformed representation, each of the F0 adjustment factor and the spectrum adjustment factor being dependent on the emotion type and the linguistic-contextual identity of the corresponding phoneme.

12. The device of claim 11, further comprising a vocoder configured to synthesize a speech waveform from the transformed representation.

13. The device of claim 11, further comprising a memory storing a neutral decision tree and an emotion-specific decision tree distinct from the neutral decision tree, the neutral duration prediction block further configured to retrieve the duration of each phoneme from the neutral decision tree, and the duration adjustment block configured to retrieve an emotion-specific adjustment factor for adjusting each duration of each phoneme from the emotion-specific decision tree.

14. The device of claim 11, the memory further holding instructions executable by the processor to:

build a phoneme sequence based on a text script;

modify the built phoneme sequence to generate a linguistic-contextual feature sequence based on extracted contextual features of the text script; wherein the plurality of phonemes of the neutral duration prediction block corresponds to the linguistic-contextual feature sequence.

15. The device of claim 11, each of the plurality of phonemes comprising a plurality of states, each of the adjustment factors applied on a per-state basis.

16. A method comprising:

generating an emotionally neutral representation of a script, the emotionally neutral representation comprising a neutral duration associated with each of a plurality of phonemes; and applying a duration adjustment factor to each neutral duration to generate a transformed duration sequence, the duration adjustment factor being dependent on an emotion type and a linguistic-contextual identity of the corresponding phoneme;

generating a neutral fundamental frequency (F0) prediction and a neutral spectrum prediction for each adjusted duration of the transformed duration sequence; and applying an F0 adjustment factor to each neutral F0 prediction and a spectrum adjustment factor to each neutral spectrum prediction to generate a transformed representation, each of the F0 adjustment factor and the spectrum adjustment factor being dependent on the emotion type and the linguistic-contextual identity of the corresponding phoneme.

17. The method of claim 16, further comprising synthesizing a speech waveform from the transformed representation.

18. The method of claim 16, further comprising:

storing a neutral decision tree and an emotion-specific decision tree distinct from the neutral decision tree;

retrieving the duration of each phoneme from the neutral decision tree, and the duration adjustment block configured to retrieve an emotion-specific adjustment factor for adjusting each duration of each phoneme from the emotion-specific decision tree.

19. The method of claim 16, further comprising:

building a phoneme sequence based on a text script; and modifying the built phoneme sequence to generate a linguistic-contextual feature sequence based on extracted contextual features of the text script; wherein the plurality of phonemes of the neutral duration prediction block corresponds to the linguistic-contextual feature sequence.

20. The method of claim 16, each of the plurality of phonemes comprising a plurality of states, each of the adjustment factors applied on a per-state basis.

* * * * *